United States Patent [19]

Baudin

[11] 4,149,833

[45] Apr. 17, 1979

[54] ROTARY MACHINE WITH PISTONS PIVOTALLY MOUNTED ON THE ROTOR

[75] Inventor: Lucien Baudin, Geneva, Switzerland

[73] Assignee: Idram Engineering Company Est., Vaduz, Liechtenstein

[21] Appl. No.: 825,076

[22] Filed: Aug. 16, 1977

Related U.S. Application Data

[62] Division of Ser. No. 693,628, Jun. 7, 1976, abandoned.

[30] Foreign Application Priority Data

Jun. 16, 1975 [CH] Switzerland ..... 7804/75

[51] Int. Cl.[2] ..... F04B 19/02; F04B 29/00; F01C 1/00; F01B 13/04

[52] U.S. Cl. ..... 417/462; 418/265; 91/197; 123/43 R

[58] Field of Search ..... 418/259, 265; 417/462, 417/463, 486, 487; 123/43 R; 91/197

[56] References Cited

U.S. PATENT DOCUMENTS

| | | | |
|---|---|---|---|
| 147,623 | 2/1874 | Ellis | 418/265 |
| 1,125,599 | 1/1915 | Simmons | 418/265 |
| 1,636,826 | 7/1927 | Morgan | 418/265 |
| 1,715,490 | 6/1929 | Ballerstedt | 418/265 |
| 2,346,218 | 4/1944 | Johnson | 417/462 |
| 2,362,541 | 11/1944 | De Lancey | 418/265 |

*Primary Examiner*—John J. Vrablik
*Attorney, Agent, or Firm*—Stevens, Davis, Miller & Mosher

[57] ABSTRACT

A rotary machine such as a pump, compressor or internal combustion engine comprises blades or pistons pivotally mounted on a rotor for cooperation with an inner cylindrical wall of a stator. A mechanism controlling the angular position of the blades or pistons comprises one or more connecting rods pivoted at one end on an axle of the stator eccentric to the rotor axis and at another end on a lever fixed for pivoting with the corresponding blade(s) or piston(s). For a machine with blades, this control mechanism is housed in a lateral cover on the stator, and for a machine with pistons, it is disposed within the rotor.

5 Claims, 19 Drawing Figures

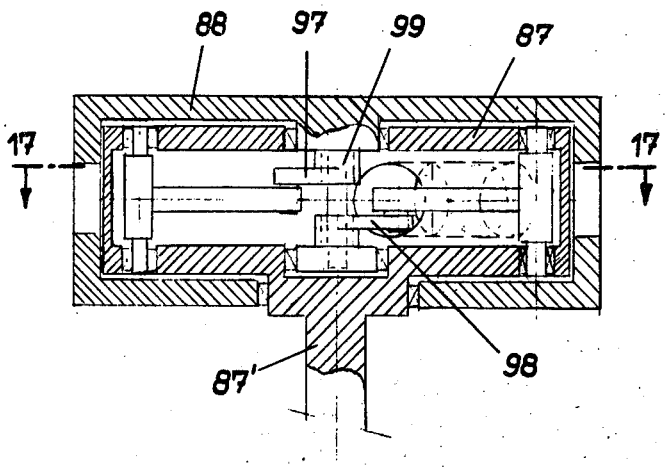
Fig. 16
Fig. 17
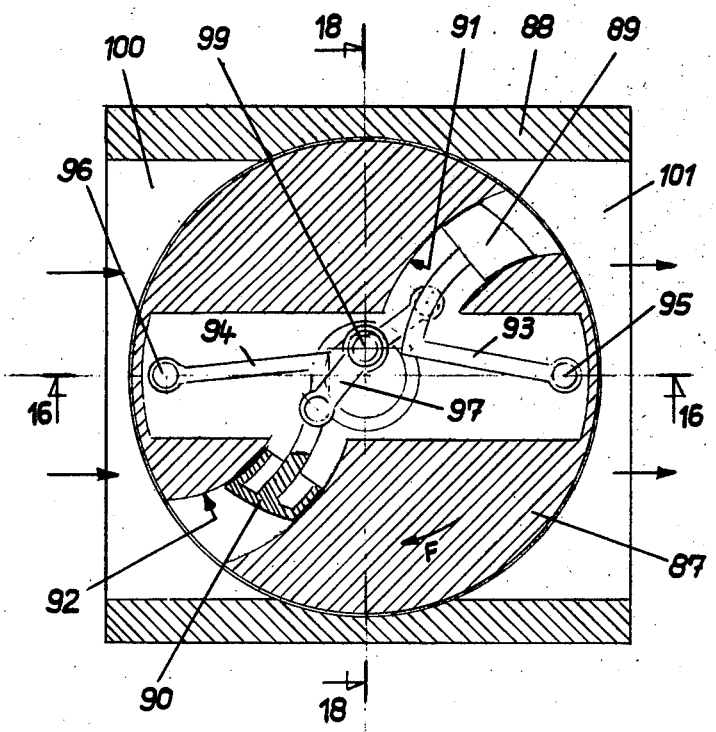
Fig. 18
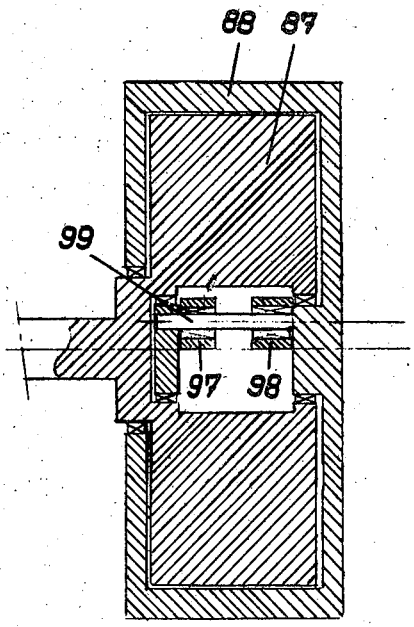

ROTARY MACHINE WITH PISTONS PIVOTALLY MOUNTED ON THE ROTOR

This is a division of application Ser. No. 693,628 filed June 7, 1976 now abandoned.

The invention relates to rotary machines, notably evacuating pumps, volumetric pumps, volumetric compressors and internal combustion engines, with controlled and held members, such as blades or pistons, pivotally mounted on a rotor, a stator in which the rotor turns with said members cooperating with an inner cylindrical wall of the stator, and a mechanism controlling the angular position of the members about their pivoting axes on the rotor.

Various arrangements have already been proposed for controlling the movements of retractable blades about their pivoting axes and in relation to the inner surface of the stator. However, no such arrangements have been provide for pistons.

In certain known rotary machines of the specified type, the mechanism controlling the angular position of the blades is mounted centrally inside the rotor. Such a mechanism may include several connecting rods mounted on an eccentric and each of which is directly connected to a blade.

It has also been proposed to provide a rotary internal combustion engine with blades movable either by the centrifugal effect or by a mechanism including gears meshing with a toothed ring of the stator.

In another known rotary internal combustion engine, blades pivotally mounted on the rotor are controlled by a connecting-rod mechanism arranged to bring the blade constantly into contact with the inner surface of the stator to form a fluid-tight chamber. Control of the blades takes place by means of an eccentric driven by a pinion meshing with a central toothed wheel fixed on the axis of the stator, these gears being mounted at the centre of the rotor.

It is also known to control blades pivoted on the rotor by a transmission system including, on either side of the rotor, gears driving connecting rods connected to the blades, these gears meshing with a pinion fixed on the axis of the stator.

The guiding of oscillations of blades in another known rotary machine is achieved by an elliptical groove in each lateral wall of the stator and in which guide pins or slides connected to the blades are movable.

In another known machine, instead of elliptical grooves there are provided eccentric grooves in which pieces fixed with the blades move.

Generally speaking, the rotary machines proposed to date are of complicated and costly structure, and involve a large number of mechanical members which necessarily increase friction and consequently reduce the efficiency. Another drawback of these known machines is that the speeds of rotation are quite limited.

Moreover, in the known arrangements, only blades are guided, not pistons.

Also, in some types of known rotary machines, the blades may be ejected by centrifugal action and come to apply against the inner surface of the stator, or jam in their casing.

The invention aims to provide a novel conception of rotary machine which remedies these drawbacks.

According to the invention, a rotary machine of the type defined at the outset is distinguished from the known machines in that the mechanism controlling the angular position of said members such as blades or pistons comprises at least one connecting rod directly pivotally connected to an axle of the stator eccentric to the axis of the rotor, said rod being pivotally connected to a lever fixed for pivoting with a corresponding retractable member.

The invention enables the provision of such a machine having blades or pistons with which it is possible to obtain perfect fluid-tightness and to provide high pressure and low vacuum.

The accompanying drawings show, by way of example, six embodiments of the invention. In the drawings:

FIG. 16 is a cross-section, along line 16—16 of FIG. 17, of a sixth embodiment;

FIG. 17 is a cross-section along line 17—17 of FIG. 16;

FIG. 18 is a cross-section along 18—18 of FIG. 17; and

Figure 1:
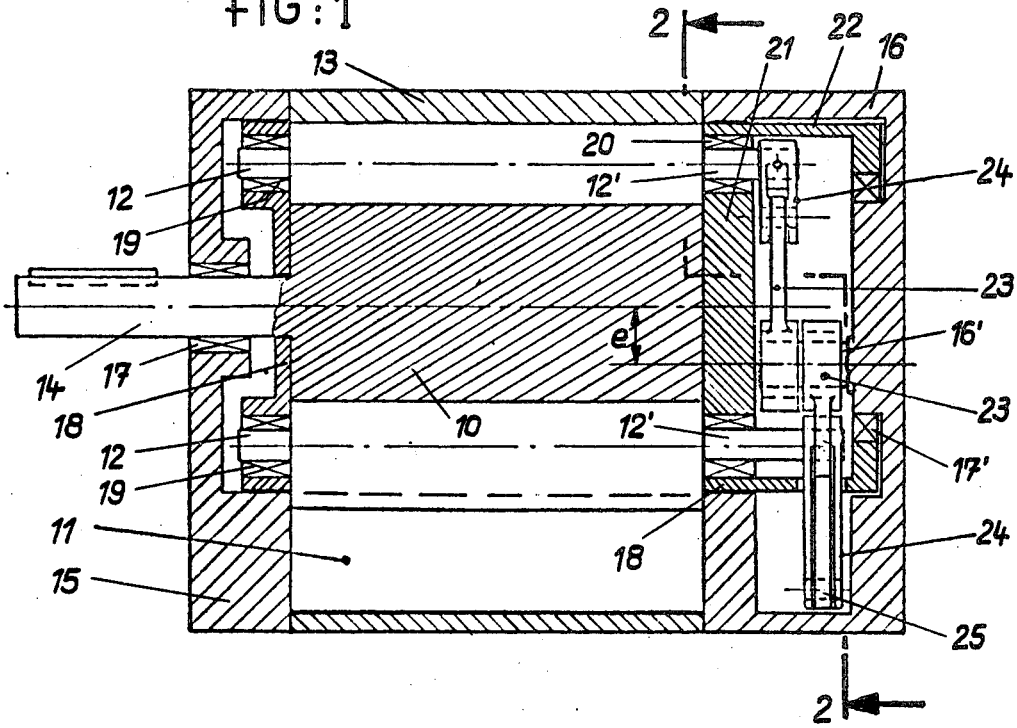
FIG. 1 is an axial cross-section, along line 1—1 of FIG. 2, of a first embodiment.
Figure 2:
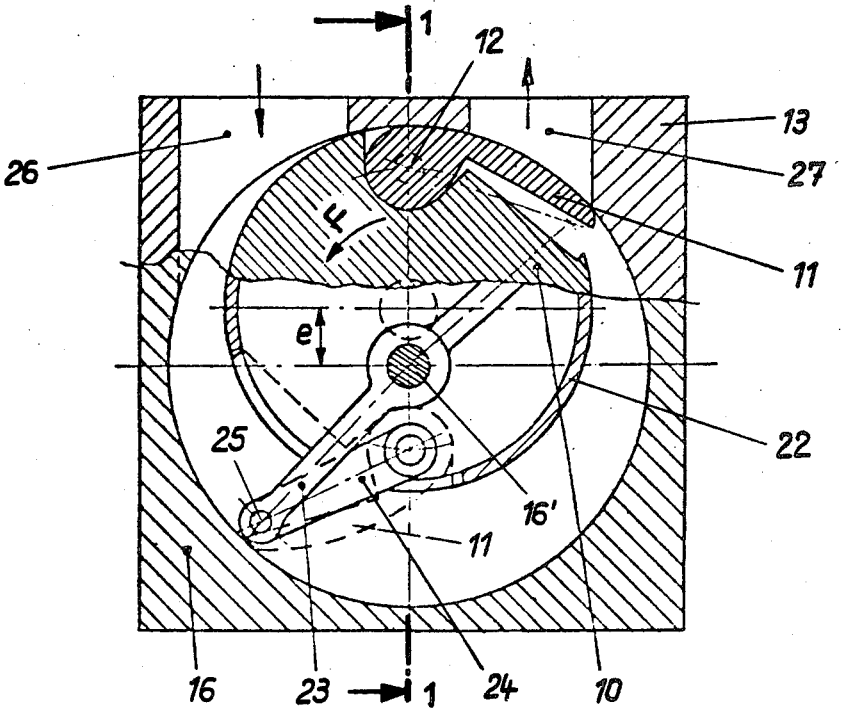
FIG. 2 is a transverse cross-section, along line 2—2 of FIG. 1, but showing the blade-control mechanism along a diagonal of the stator of square section.
Figure 3:
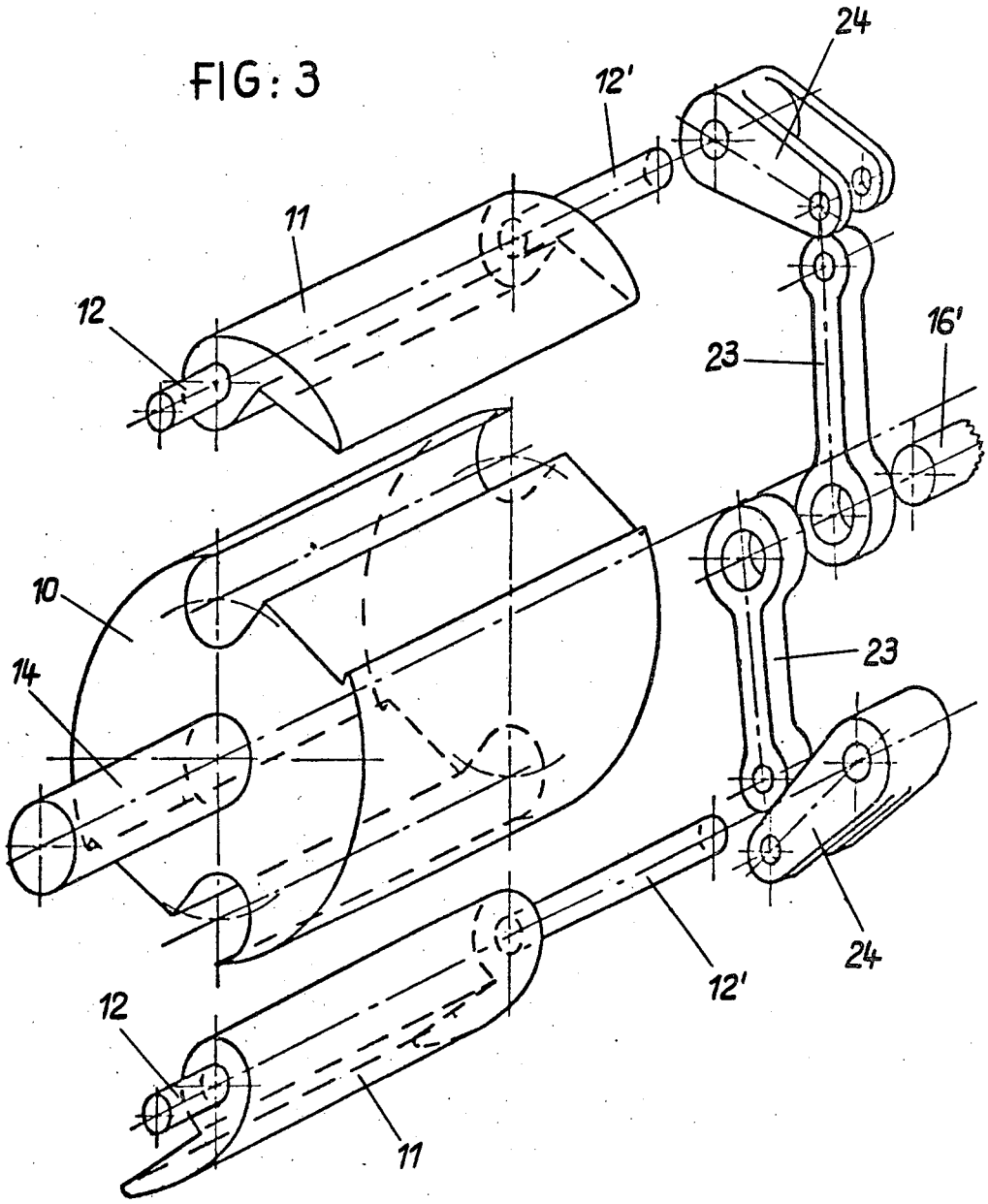
FIG. 3 is an exploded perspective view of part of the embodiment of FIGS. 1 and 2.

The rotary machine shown in FIGS. 1 to 3 comprises a rotor 10 provided with retractable blades 11 pivotally mounted on gudgeon pins 12, 12', and a hollow stator 13 inside which the rotor 10 turns. One end of the rotor 10 is mounted on a driving shaft 14 whose geometrical axis is eccentric to the axis of stator 13 by an amount e, and its other end on a support element 22 disposed in a cover 16 fixed on stator 13.

The stator 13 has two lateral covers 15 and 16. Cover 15 supports a bearing 17 for the rotor shaft 14 and cover 16 supports a bearing 17' for the support element 22 which is fixedly connected to the rotor 10. The cover 16 encloses a mechanism for controlling the angular position of the blades 11 about their gudgeon pins 12, 12'. It is noted that the axes of these pins 12, 12' are parallel to the rotor shaft 14, and pin 12' is longer than pin 12.

The pins 12 are supported in a circular plate 18 of the rotor 10 by bearings 19. The pins 12' at the other end of rotor 10 are supported in bearings 20 in an end wall of the support element 22 which has a cylindrical wall and is rotatably mounted in the cover 16 on bearing 17'.

The control mechanism of the retractable blades 11 comprises, for each blade, a connecting rod 23 journalled at one end on an axle 16' disposed on the stator axis and fixed on cover 16. The other end of rod 23 is pivotally connected at 25 to a fork lever 24 keyed or otherwise fixed on the gudgeon pin 12' of the blade 11.

It is noted that the pivoting axis 25 of the rod 23 and lever 24 is disposed at the centre of curvature of the rounded end part of blade 11.

The described rotary machine may be used as a compressor, evacuating pump, volumetric pump or a turbine.

FIG. 2 shows an application of the machine as a compressor in which the stator 13 has an intake port 26 and an exhaust port 27, these ports extending along the entire length of the inner wall of the stator 13 past which the blades 11 sweep.

Operation of the described rotary machine is as follows:

The rotor 10 is rotated in the direction of arrow F by the driving shaft 14 coupled to a motor, not shown. This rotation is communicated to the blades 11 whose pins 12' drive the levers 24 connected to rods 23. Because of the eccentricity of the axle 16' from the rotor axis and the specific length of rod 23, i.e. the particular position of the pivoting axis 25 of rod 23 on lever 24, the blades 11 are pivoted about their pins 12, 12' in such a manner that the tail end of each blade 11 is moved tangentially to the inner cylindrical surface of stator 13 as the rotor 10 turns.

When the rotor 10 turns in the direction of arrow F, one blade 11, i.e., the one in the lower position of FIG. 2, sucks in a certain volume of fluid through port 26. This fluid is then transported in the space comprised between the two diametrally opposed blades 11 and is expelled through the exhaust port 27 to terminate the cycle.

The described rotary machine is very simple and economical, as all of the parts are of elementary geometrical shape and do not need machining of high precision. The small number of parts enables a reduction of weight and bulk compared to known rotary machines.

Moreover, the great possible eccentricity of the rotor, the absence of friction of the blades on the stator, and balancing enable: a high output, the elimination of lubrication in the working chamber, high speeds of rotation, and a very high efficiency.

Figure 4:
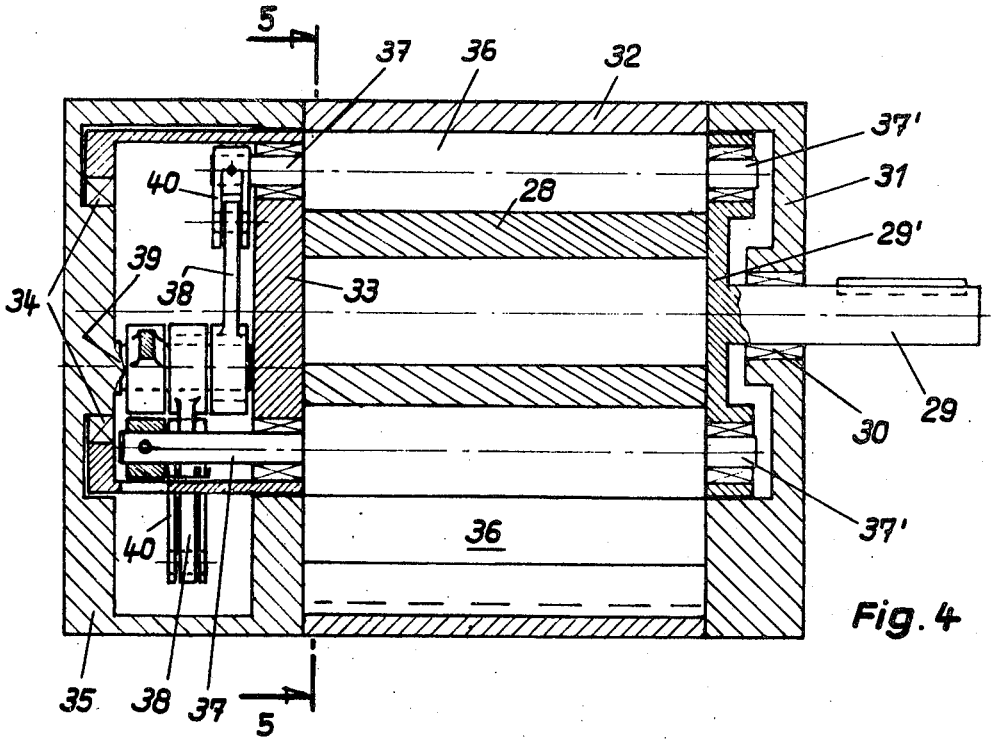
FIG. 4 is a cross-section, along line 4—4 of FIG. 5, of a second embodiment.
Figure 5:
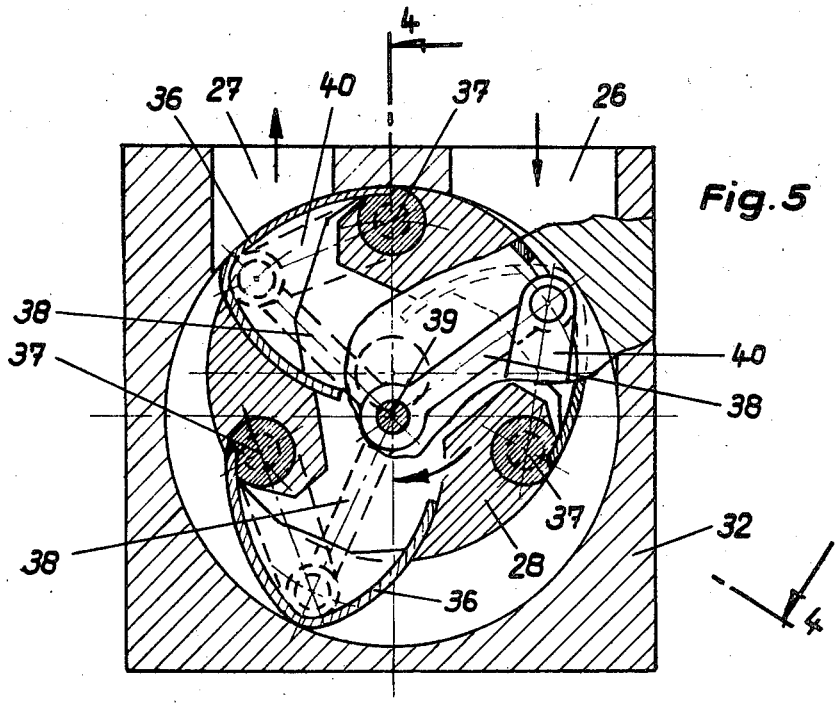
FIG. 5 is a cross-section along line 5—5 of FIG. 4.
Figure 6:
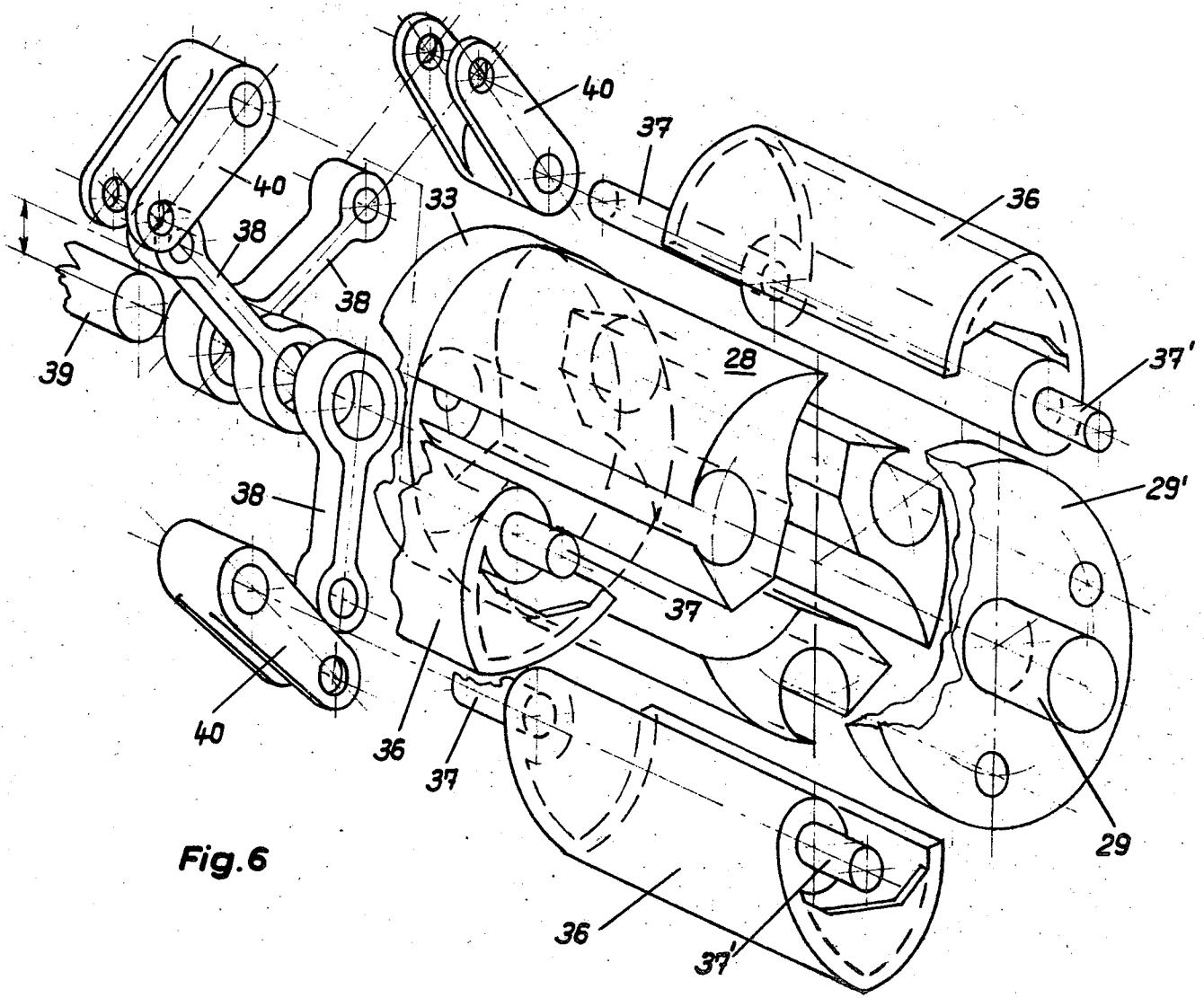
FIG. 6 is an exploded perspective view of part of the second embodiment.

The second embodiment of rotary machine, FIGS. 4 to 6, comprises a rotor 28 whose driving shaft 29 integral with a disc 29' is journalled in a bearing 30 in cover 31 of stator 32. The other end of rotor 28 is carried by a support element 33 mounted on a bearing 34 carried by a second cover 35 of the stator, as in the first embodiment. Cover 35 contains a connecting-rod control mechanism that will be described later on.

Three blades 36 of dihedral shape are mounted on the rotor 28 and have longitudinal gudgeon pins 37, 37' carried respectively by rotor discs 33 and 29'. The pins 37 are longer than pins 37' and extend in the cover 35 for connection to rods 38 connected to a shaft 39 fixed on cover 35 and disposed, eccentric to the axis of rotor 28, on the stator axis. Fork levers 40 are each keyed on one of the pins 37 and pivotally connected to the free end of a rod 38 about an axis which extends inside the dihedron of the corresponding blade 36. The dihedron of each blade 36 is composed of two symmetrical curved parts: a first part extending from the pins 37, 37' and which has a complementary curvature to the inner cylindrical wall of stator 32; and a second part extending to a free end, with its curvature centred about the axis of pins 37, 37' and which moves in contact with a complementary recessed wall of rotor 28 which receives this second part of the blade.

Operation of this embodiment is as follows:

When the rotor 28 turns in the direction of the arrow, the blades 36 pivot about their pins 37,37' by the intermediary of levers 40 and the rods 38 in such a manner as to come into contact with the inner surface of stator 32. As in the embodiment of FIG. 2, the blades 27 sweep past intake and exhaust ports 26, 27. A certain quantity of fluid, air in the case of a volumetric compressor, is sucked through port 26 and transported in the space comprised between two blades 36, then expelled through the exhaust port 27 and the cylce recommences.

This second embodiment has the same advantages as mentioned for the machine of FIGS. 1 to 3.

Figure 7:
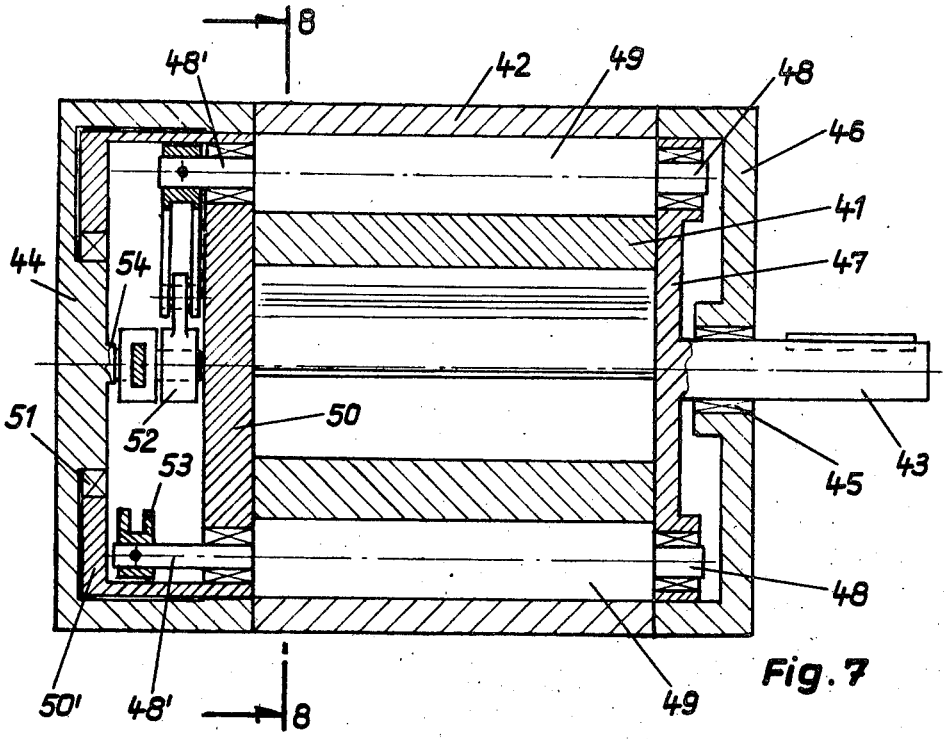
FIG. 7 is a cross-section, along line 7—7 of FIG. 8, of a third embodiment.
Figure 8:
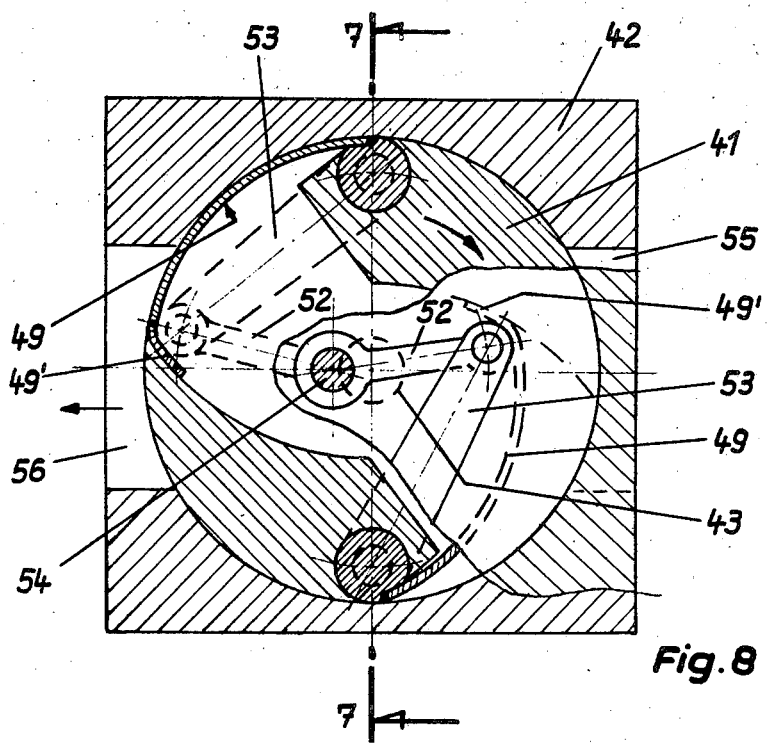
FIG. 8 is a cross-section along line 8—8 of FIG. 7.
Figure 9:
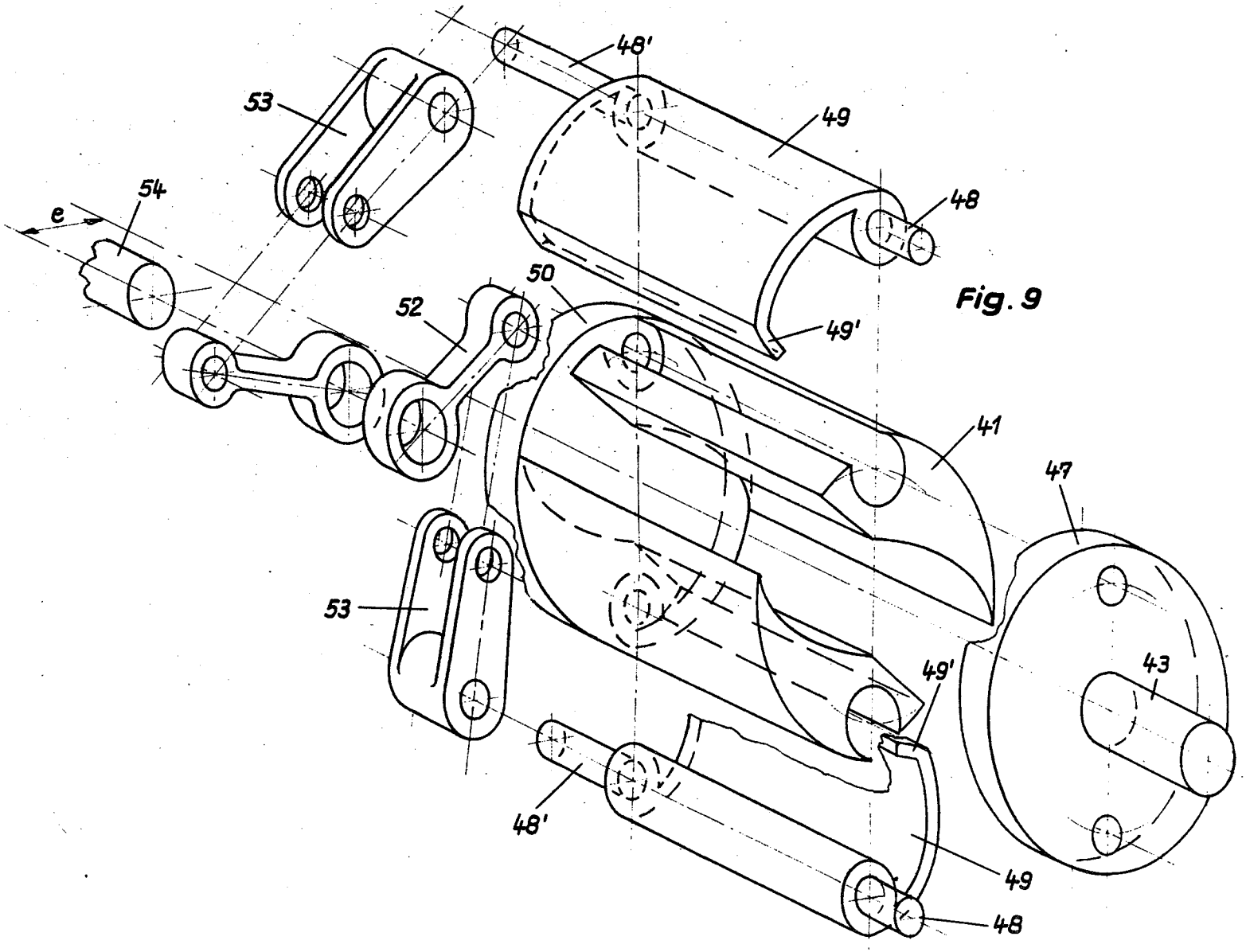
FIG. 9 is an exploded perspective view of a part of the third embodiment.

The third embodiment of rotary machine, FIGS. 7 to 9, is distinguished from that of FIGS. 4 to 6 by the fact that the cylindrical rotor 41 is coaxial with the cylindrical cavity of stator 42.

The rotor 41 is mounted in the same manner as in the previous embodiment, with its driving shaft 43 journalled in a bearing 45 carried by a cover 46 of stator 42. The shaft 43 is integral with a disc 47 carrying gudgeon pins 48 of blades 49. The other end of the rotor 41 is supported by a disc 50 of a support element 50' which has a cylindrical wall and is rotatably mounted on a bearing 51 carried by a cover 44 fixed to stator 42.

In this embodiment, the machine comprises two diametrally opposed blades 49 retractable in housings in the rotor 41. These blades have a cylindrical surface and terminate with a folded edge 49' moving in contact with a wall of a complementary housing in the rotor 41. A mechanism for controlling the blades 49 is also disposed laterally in the cover 44, and comprises connecting rods 52 and coupling levers 53, the rods 52 being mounted on an axle 54 integral with cover 44 and eccentric to the common axis of the rotor and stator by an amount e, as shown in FIGS. 8 and 9. The levers 53 are keyed on gudgeon pins 48' of the blades 49 and pivotally connected at their other ends to rods 52.

Operation of this machine is similar to that of the preceding example. The rods 52 and levers 53 of the blade-control mechanism are dimensioned in a manner to move these blades in the recess in rotor 41 to suck fluid in through an intake port 55 of the stator 42 and expel this fluid through an exhaust port 56 diametrally opposite the intake port 55.

Figure 10:
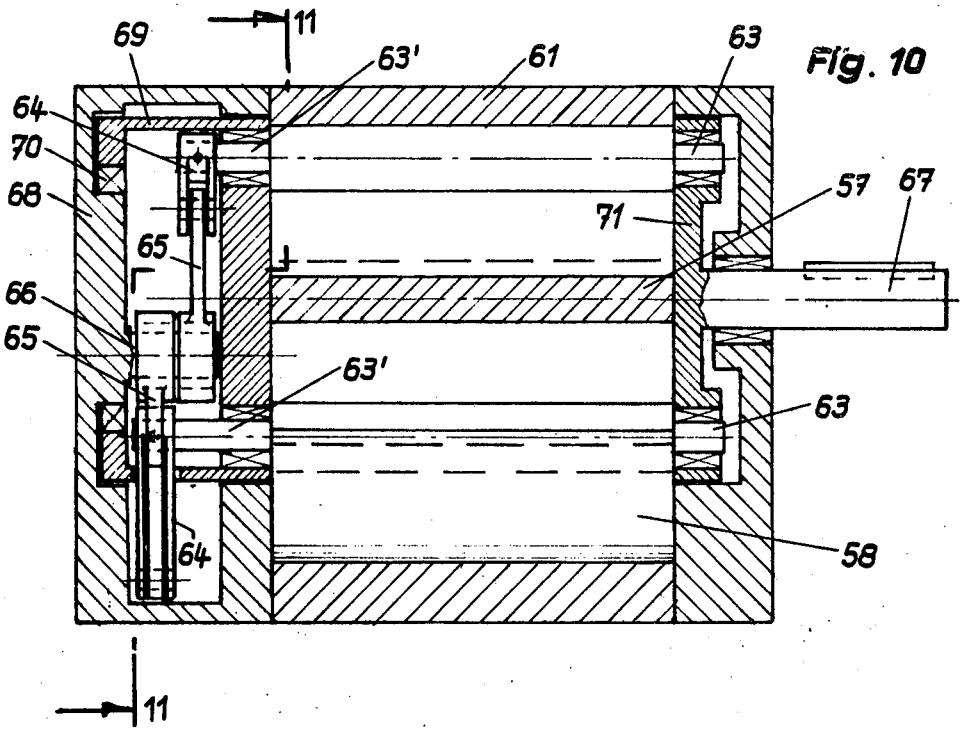
FIG. 10 is a cross-section, along line 10—10 of FIG. 11, of a fourth embodiment.
Figure 11:
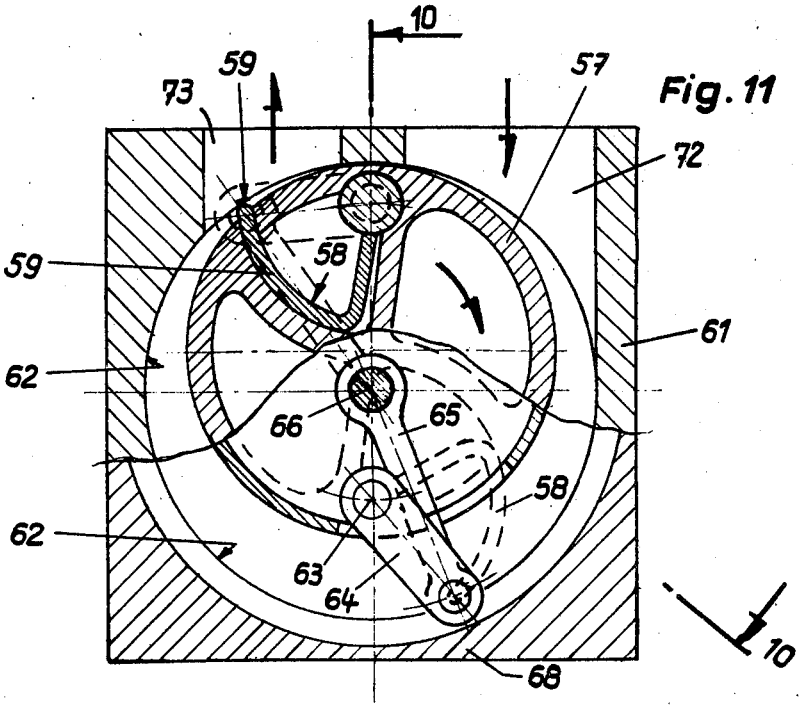
FIG. 11 is a cross-section along line 11—11 of FIG. 10.
Figure 12:
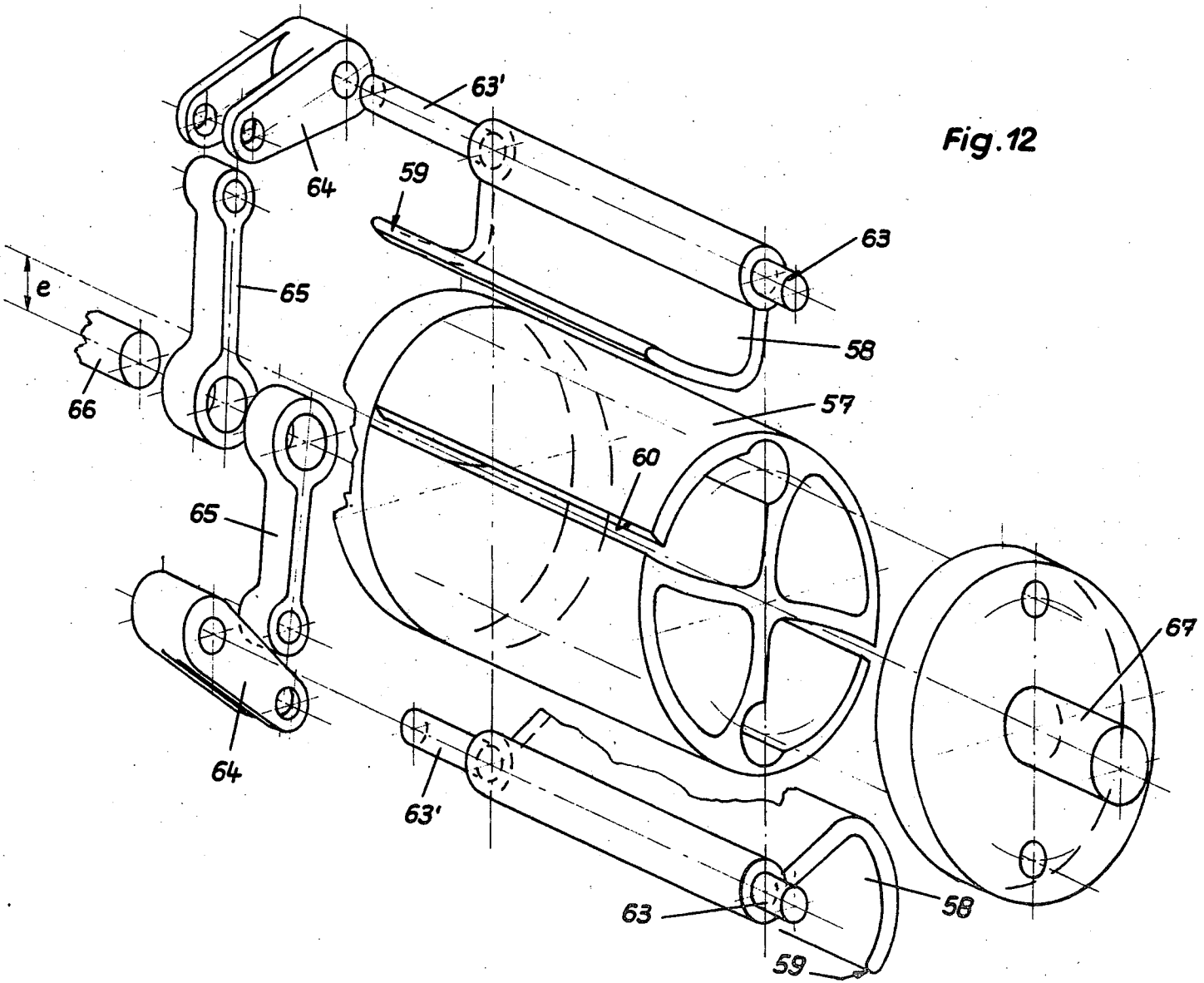
FIG. 12 is an exploded perspective view of a part of the fourth embodiment.

The embodiment of FIGS. 10 to 12 is quite similar to that of FIGS. 4 to 6 with the differences that rotor 57 has only two diametrally opposed blades 58 also of dihedral shape, and the free edge parts 59 of the dihedral blades 58 move in slots 60 in the rotor 57 to come into contact with the inner wall 62 of stator 61. Each blade 58 is mounted on longitudinal gudgeon pins 63, 63'; on the longer pins 63' are keyed levers 64 pivotally connected to rods 65 pivotally mounted on an axle 66 on the stator axis and eccentric to the rotor axis by an amount e (FIG. 12). As in the previous embodiments, the blade-control mechanism is housed in a cover 68 fixed to stator 61. Cover 68 also carries a bearing 70 on which is mounted a rotary support element 69 fixed to rotor 57. Rotor 57 has a drive shaft 67 integral with a disc 71 carrying the blade pins 63.

When the rotor 57 turns in the direction of the arrow, the blades 58 alternately suck in fluid through an intake opening 72, move this fluid in the space between the rotor and the stator and then expel it through the exhaust opening 73. This machine may be used as an evacuating pump, a volumetric pump or a volumetric compressor.

Figure 13:
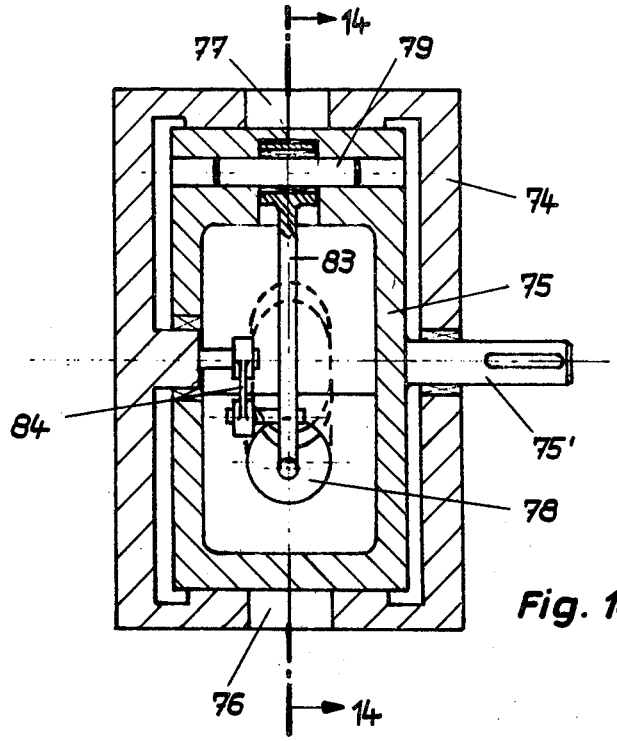
FIG. 13 is a cross-section, along line 13—13 of FIG. 14, of a fifth embodiment.
Figure 14:
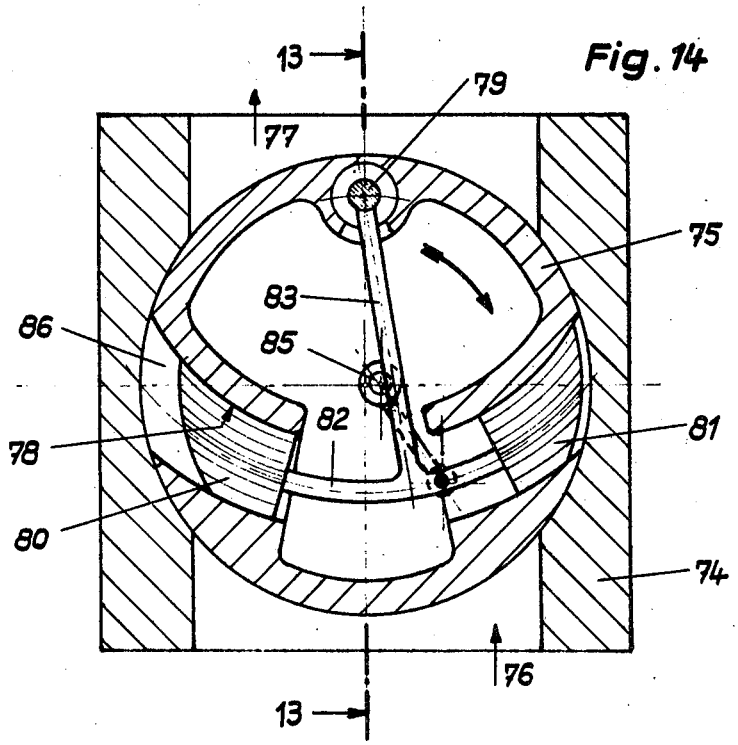
FIG. 14 is a cross-section along line 14—14 of FIG. 13.
Figure 15:
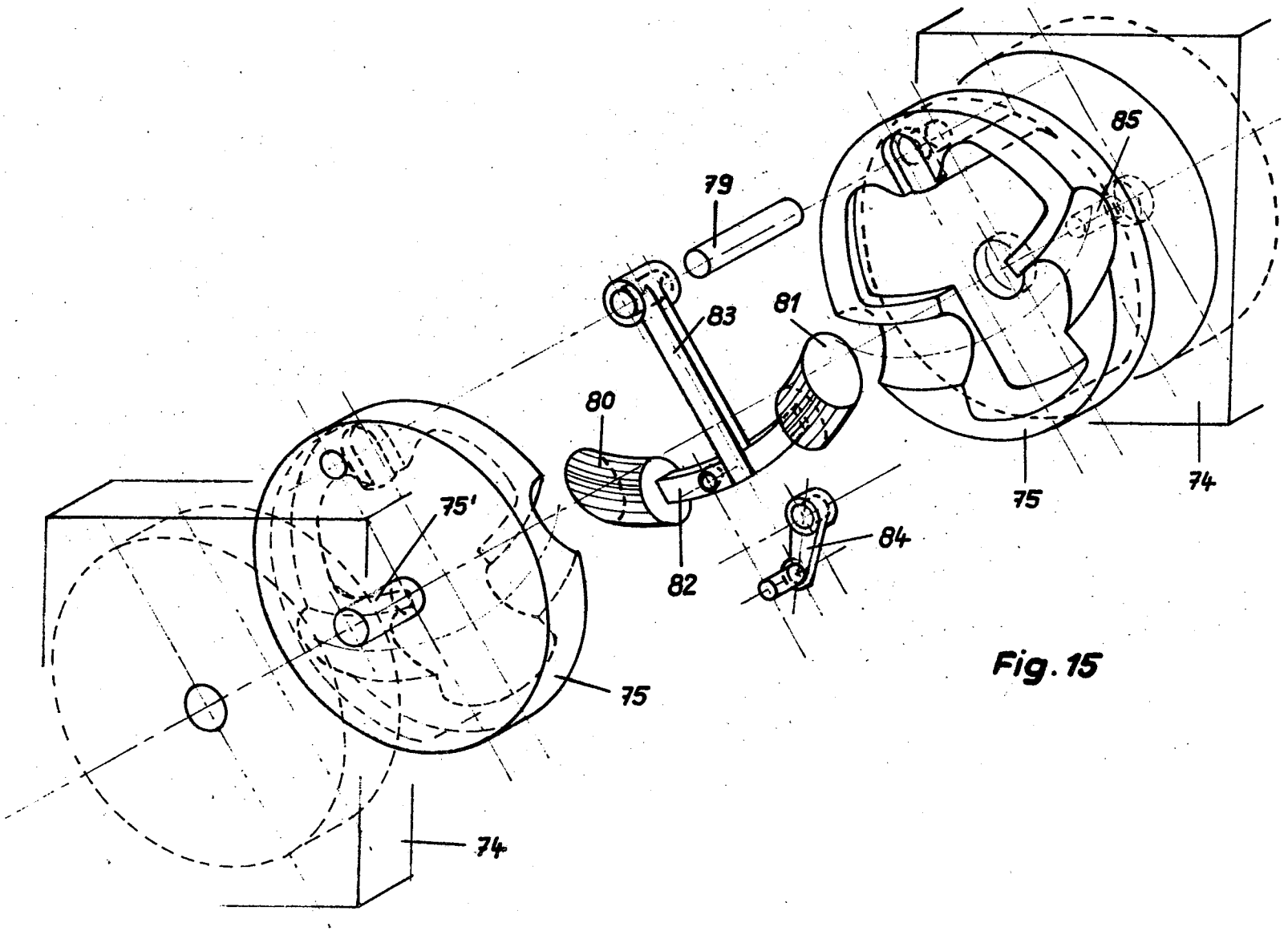
FIG. 15 is an exploded perspective view of a part of the fifth embodiment.
Figure 19:
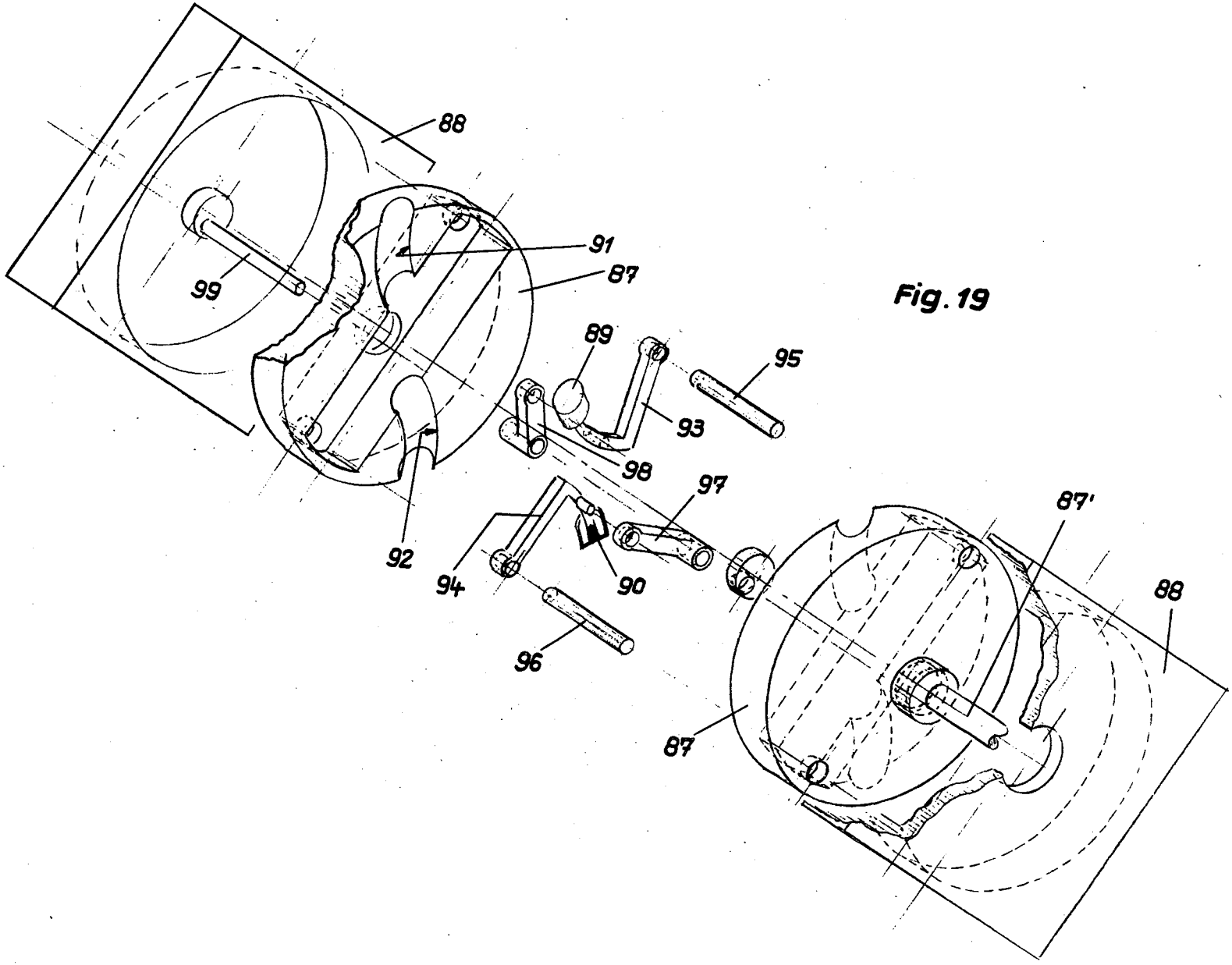
FIG. 19 is an exploded perspective view of a part of the sixth embodiment.

The embodiment shown in FIGS. 13 to 15 is a piston-type machine used as an evacuating pump, a volumetric pump or a volumetric compressor.

This machine comprises a stator 74 and a hollow cylindrical rotor 75 as shown in FIGS. 13 and 14. The stator 74 has an intake port 76 and an exhaust port 77.

The rotor 75, which is coaxially mounted in a cylindrical recess the stator 74, has a pair of toric chambers 78 centred on the axis of a pivoting pin 79 carried by the rotor. Two toric pistons 80, 81 fixed together by a rod 82 are slidably mounted in the toric openings 78. A rocker 83 fixed to the rod 82 joining pistons 80, 81 is pivoted at one end on the pin 79. A mechanism for controlling the pistons 80, 81 is mounted inside the rotor 75 and comprises a rod 84 pivotally connected at one end to a fixed pin 85 eccentric to a driving shaft 75' of the rotor 75 and at the other end to the rod 82.

When the rotor 75 turns in the direction of the arrow, the rod 84 oscillates rod 82 and rocker 83 between two extreme positions in one of which the piston 81 is in the immediate vicinity of the inner wall of stator 74 while the piston 80 is in its position furthest away from this wall of the stator to provide a fluid-intake chamber 86 for sucking fluid through the intake port 76.

Another embodiment of a rotary piston machine is shown in FIGS. 16 to 19, in which a cylindrical rotor 87 is coaxially mounted in a stator 88 as in the example of FIGS. 13 to 15.

Two diametrally opposite pistons 89, 90 are movably mounted in recesses 91, 92 respectively.

Each piston 89, 90 is fixed to a respective rocker 93, 94 pivoted on a pin 95, 96 of rotor 87. A mechanism for controlling the rectractable pistons 89, 90 comprises, for each piston, a respective connecting rod 97, 98 (FIG. 16) connected on the one hand to an axle 99 fixed on the stator 88 and eccentric to the driving shaft 87' of rotor 87 and, on the other hand, to the corresponding rocker 93, 94.

The stator 88 has an intake port 100 and an exhaust port 101.

To provide a thermic rotary engine, it suffices to combine in staged formation two compressors such as that shown in FIGS. 16 to 19. An explosive mixture is taken in by the piston of the first compressor, compressed during rotation and as soon as the desired pressure has been reached, all of the compressed mixture is expelled into the intake of the second compressor. This transfer at high pressure only absorbs a small fraction of the intake time of the driving piston. Ignition of the mixture by means of a conventional spark plug placed on the rotor or stator takes place immediately after passage by the intake port. The pressure of the ignited mixture on the piston which is still in its intake phase makes the rotor turn, then during its exhaust phase the piston expels all of the ignited mixture.

The described piston machines may include more than one rocker and more than two pistons, for example four pistons disposed symmetrically in relation to the plane through the rotor axis and the eccentric axis of the connecting rods. Likewise, for the other described embodiments, the number of blades may be modified.

For both the blade and piston types of rotary machines, scrapers may be provided to perfect the fluid-tightness.

An advantage of the described blade and piston rotary machines is to eliminate friction between the blade or piston and the stator and its casing without detriment to the fluid-tightness. Other advantages reside in the simplicity of the structure and the fact that forced lubrication by oil or water in the working chamber is not needed. Moreover, for the blade type, the mechanical control members are entirely separated from the working chamber which enables them to be lubricated in a rational manner. Also, the described machines can operate at very great speeds of rotation with an improvement of the efficiency and an appreciable reduction of the weight and bulk for the same output/pressure values as known machines.

The parts of the described machines may be manufactured in various materials, notably plastic materials such as polytetrafluorethylene, and epoxy glass which have the advantage of avoiding lubrication of the rotary members and to permit a reduction of the manufacturing cost. This also produces an economy in driving of the machine. It is of course also possible to use metals, for example aluminium or other light metals.

These machines may be used to create a decompression or a compression, or to supply a fixed or variable volumetric output whatever be the nature of the fluid or gas.

The low bulk of the machines makes them advantageous for use as anti-pollution pumps for automobiles; compressors for air-conditioning or ventilation in general, and in particular for automobiles; pumps for any plant for transforming energy into any form whatsoever; compressed-air rotary pumps for pneumatic tools; and pumps and vacuum pumps in the fields of the chemical, food and medical industries, in particular when corrosive materials are involved.

What we claim is:

1. A rotary machine comprising:

a stator having an inner substantially cylindrical wall defined about a first axis;

means defining a fluid intake passage in said wall;

means defining a fluid exhaust passage in said wall;

a rotor in said stator, said rotor having a cylindrical outer surface of a diameter substantially equal to that of the cylindrical inner wall and being rotatably driven about said first axis;

means defining a cavity in said rotor;

a rigid bent lever pivotally mounted on said rotor about a second axis substantially parallel to said first axis;

a crank rod pivotable at one end thereof about a third fixed axis substantially parallel to said first axis and eccentrically disposed relative thereto, said rod being pivotably connected at the other end thereof to said lever about a fourth axis substantially parallel to said first axis;

a piston in said cavity, said piston being fixedly connected to said lever whereby when said rotor is rotatably driven said crank rod moves, said lever pivots and said piston reciprocally moves in said cavity.

2. A rotary machine comprising:

a stator having an inner substantially cylindrical wall defined about a first axis;

means defining a fluid intake passage in said wall;
means defining a fluid exhaust passage in said wall;
a rotor in said stator, said rotor having a cylindrical outer surface of a diameter substantially equal to that of the cylindrical inner wall and being rotatably driven about said first axis;
means defining a pair of cavities extending inwardly from the cylindrical outer surface of said rotor;
a rocker arm pivotally connected at one end to said rotor about a second axis substantially parallel to said first axis;
a corresponding piston reciprocally movable in each of said cavities, one of said pistons being fixedly connected to one side of the other end of said rocker arm and the other one of said pistons being fixedly connected to the other side of the other end of said rocker arm;
a connecting rod pivotable at one end thereof about a third fixed axis substantially parallel to said first axis and eccentrically disposed relative thereto, said rod being pivotably connected at the other end thereof to said rocker arm about a fourth axis substantially parallel to said first axis whereby when said rotor is rotatably driven, said connecting rod moves, said rocker arm pivots and said pistons reciprocally move in their corresponding cavities.

3. A rotary machine comprising:
a stator having an inner substantially cylindrical wall defined about a first axis;
means defining a fluid intake passage in said wall;
means defining a fluid exhaust passage in said wall;
a rotor in said stator, said rotor having a substantially outer surface of a diameter substantially equal to that of the cylindrical inner wall and being rotatably driven about said first axis;
means defining a pair of cavities extending inwardly from the cylindrical outer surface of said rotor;
a rocker arm pivotally connected at one end thereof to said rotor about a second axis substantially parallel to said first axis and adjacent the cylindrical outer surface;
a corresponding piston reciprocally movable in each of said cavities, one of said pistons being fixedly connected to one side of the other end of said rocker arm and the other one of said pistons being fixedly connected to the other side of the other end of said rocker arm;
said pistons and said cavities being toric shaped relative to a center at said second axis, said pistons being reciprocally movable along a part-circumferentially extending path centered at said second axis; and
a connecting rod pivotable at one end thereof about a fixed third axis substantially parallel to and adjacent to said first axis and eccentrically disposed relative thereto, said rod being pivotably connected at the other end thereof to the other end of said rocker arm whereby when said rotor is rotatably driven, said connecting rod moves, said rocker arm pivots about said second axis and said pistons reciprocally move in their corresponding cavities.

4. A rotary machine comprising:
a stator having an inner substantially cylindrical wall defined about a first axis;
means defining a fluid intake passage in said wall;
means defining a fluid exhaust passage in said wall;
a rotor in said stator, said rotor having a substantially cylindrical outer surface of a diameter substantially equal to that of the cylindrical inner wall and being rotatably driven about said first axis;
means defining a pair of cavities extending inwardly from the cylindrical outer surface of said rotor;
a first rocker arm pivotally connected at one end thereof to said rotor about an axis substantially parallel to said first axis;
a second rocker arm pivotally connected at one end thereof to said rotor about an axis substantially parallel to said first axis;
a corresponding reciprocally movable piston in each of said cavities, one of said pistons being fixedly connected to the other end of said first rocker arm and the other one of said pistons being fixedly connected to the other end of said second rocker arm;
a first connecting rod pivotable at one end thereof about a second fixed axis substantially parallel to said first axis and eccentrically disposed relative thereto, said first rod being pivotably connected at the other end thereof to said first rocker arm;
a second connecting rod pivotable at one end thereof about said second axis, said second rod being pivotably connected at the other end thereof to said second rocker arm whereby when said rotor is rotatably driven, said connecting rods move, said rocker arms pivot, and said pistons reciprocally move in said cavities.

5. A rotary machine comprising:
a stator having an inner substantially cylindrical wall defined about a first axis;
means defining a fluid intake passage in said wall;
means defining a fluid exhaust passage in said wall;
a rotor in said stator, said rotor having a substantially cylindrical outer surface of a diameter substantially equal to that of the cylindrical inner wall and being rotatably driven about said first axis;
means defining a pair of substanting diametrically opposed cavities extending inwardly from the cylindrical outer surface of said rotor;
a first rocker arm pivotally connected at one end thereof to said rotor about a second axis substantially parallel to said first axis and adjacent the cylindrical outer surface;
a second rocker arm pivotally connected at one end thereof to said rotor about a third axis substantially parallel to said first axis, adjacent the cylindrical outer surface and diametrically opposite said second axis;
a corresponding reciprocally movable piston in each of said cavities, one of said pistons being fixedly connected to the other end of said first rocker arm and the other one of said pistons being fixedly connected to the other end of said second rocker arm;
said one piston and corresponding cavity being toric shaped relative to a center at said second axis, said one piston being reciprocally movable along a part-circumferentially extending path centered at said second axis;
said other piston and corresponding cavity being toric shaped relative to a center at said third axis, said other piston being reciprocally movable along a part-circumferentially extending path centered at said third axis;

a first connecting rod pivotable at one end thereof about a fourth fixed axis substantially parallel to and adjacent said first axis and eccentrically disposed relative thereto, said first rod being pivotably connected at the other end thereof to said first rocker arm;

a second connecting rod pivotable at one end thereof about said fourth axis, said second rod being pivotably connected at the other end thereof to said second rocker arm whereby when said rotor is rotatably driven, said connecting rods move, said rocker arms pivot, and said pistons reciprocally move in said cavities.

* * * * *